US005237334A

United States Patent [19]

Waters

[11] Patent Number: 5,237,334

[45] Date of Patent: Aug. 17, 1993

[54] FOCAL PLANE ANTENNA ARRAY FOR MILLIMETER WAVES

[76] Inventor: William M. Waters, 765 Cougar Dr., Millersville, Md. 21108

[21] Appl. No.: 876,696

[22] Filed: Apr. 28, 1992

Related U.S. Application Data

[63] Continuation of Ser. No. 372,963, Jun. 29, 1989, abandoned.

[51] Int. Cl.[5] ..... H01Q 23/00; H01Q 19/06; H01Q 21/06

[52] U.S. Cl. ..... 343/753; 343/776

[58] Field of Search ..... 343/753, 754, 755, 770, 343/771, 776, 778, 786, 909, 700 MS File; 358/110; 342/179, 351

[56] References Cited

U.S. PATENT DOCUMENTS

| | | | |
|---|---|---|---|
| Re. 32,369 | 3/1987 | Stockton et al. | 343/700 MS |
| 3,403,399 | 9/1968 | Jacobs et al. | 358/110 |
| 3,524,016 | 8/1970 | Jacobs et al. | 358/110 |
| 3,924,239 | 12/1975 | Fletcher et al. | 343/909 |
| 4,251,817 | 2/1981 | Kimura et al. | 343/5 DD |
| 4,431,997 | 2/1984 | Sasser et al. | 343/770 |
| 4,527,165 | 7/1985 | de Ronde | 343/778 |
| 4,571,591 | 2/1986 | Valentino et al. | 343/754 |
| 4,590,478 | 5/1986 | Powers et al. | 343/700 MS |
| 4,596,915 | 6/1986 | Simpson | 219/10.55 |
| 4,616,233 | 10/1986 | Westerman | 343/792.5 |
| 4,620,146 | 10/1986 | Isihikawa et al. | 324/58.5 |
| 4,626,863 | 12/1986 | Knop et al. | 343/781 |
| 4,644,362 | 2/1987 | Rammos | 343/778 |
| 4,654,622 | 3/1987 | Foss et al. | 338/14 |
| 4,819,004 | 4/1989 | Argintaru | 343/778 |
| 4,888,597 | 12/1989 | Rebiez et al. | 343/778 |
| 4,910,523 | 3/1990 | Huguenin et al. | 342/179 |

OTHER PUBLICATIONS

K. S. Yngvesson, Imaging Front End Systems for MM Waves and Sub-MM Waves. Conf. on Sub-MM Spectroscopy, Cannes, France, Dec. 1985, 10 pages.

Yngvesson et al. MM-Wave Imaging System with an Endfire Receptor Array, 10th Int. Conf. on Infrared and MM Waves, Orlando, Fla. Dec. 1985, 2 pages.

Chew et al., Millimeter-Wave Imaging Using FET Detectors Integrated with Printed Circuit Antennas, Internation Journal of Infrared and Millimeter Waves vol. 10 No. 5 May 1989, pp. 565-578.

Rutledge et al., Imaging Antenna Arrays vol. AP30 No 4 Jul. 1982 pp. 535-540 IEEE Trans. on Ant. & Prop.

*Primary Examiner*—Rolf Hille

*Assistant Examiner*—Peter Toby Brown

[57] ABSTRACT

A millimeter wave imaging system receives millimeter wave radiation and provides video imaging signals based thereon. The system comprises an imaging lens for receiving incoming radiation; a focal plane antenna array disposed at the focal plane of the lens on which radiation received by the lens is focussed; and signal processing and display circuitry for processing the output of the antenna array and for producing and displaying corresponding video imaging signals. The focal plane antenna array comprises a planar array of a plurality of conical horns and circular waveguides which, in use, are disposed at the focal plane of the lens; and a microstrip detector assembly coupled to the waveguides for detecting the radiation received thereby. The microstrip detector assembly comprises a dielectric substrate having a plurality of microstrip conductors embedded therein, each microstrip conductor being coupled to a respective one of the waveguides, and a diode detector being connected to each microstrip conductor. A solid state commutator samples the output of the detectors and provides a resultant video imaging control signal.

5 Claims, 5 Drawing Sheets

FOCAL PLANE ANTENNA ARRAY FOR MILLIMETER WAVES

This application is a continuation of Ser. No. 07/372963, filed Jun. 29, 1989, which is now abandoned.

FIELD OF THE INVENTION

This invention relates to a focal plane antenna array for millimeter waves and to a vidicon system for providing video imaging signals which incorporates the antenna array.

BACKGROUND OF THE INVENTION

A well-known video imaging system is that used in television, wherein the lens of the TV camera focuses energy to be imaged onto a focal plane surface. At optical wave lengths, this surface may consist of a photosensitive surface on an appropriate supporting structure. At millimeter (mm) wave lengths, the lens is substantially larger and the energy sensing surface is formed by an array of antennas, each of which feeds a detector. If the distance from the lens to the focal plane, divided by the diameter of the lens equals one ($f/D=1$), the antennas would be spaced apart a distance equal to one wavelength ($\lambda$). Such a focal plane array, used in combination with a mm-wavelength lens, can be considered to be a mm-wave TV camera.

Printed arrays of antennas integrated with detectors have been constructed in both open (dipole) and closed form. Dipoles are more susceptible to high power interference from low frequency radars than arrays of open ended waveguide antennas (which as described below are employed by the present invention), because of the high attenuation of energy below waveguide cut-off provided by open ended waveguide antennas. A mm wave vidicon involving detectors read by an electron beam has been previously suggested.

SUMMARY OF THE INVENTION

In accordance with the present invention, an efficient, yet economical focal plane antenna array assembly for millimeter waves is provided which is particularly adapted for use as part of a vidicon system of the general type described above.

In a preferred embodiment, the assembly comprises a planar array of open ended waveguides coupled through corresponding slots to associated stripline conductors and detectors. The detectors are preferably formed by an array of monolithically fabricated gallium arsenide (GaAs) diodes. The diodes are coupled to switching or commutating devices which sequentially output video imaging signals. The commutating devices are preferably solid state switching devices such as field effect transistors (FETs).

According to a preferred embodiment of the invention, an economically manufactured waveguide array is provided in the form of a plate of conductive material impermeable to the radiation. This material is preferably aluminum because of the light weight thereof. The plate is perforated, as by drilling or punching, to provided passages defining the waveguide. The thickness of the plate is selected to provide waveguides of the desired length so that unwanted low frequency interference is rejected. As noted above, radiation received by the waveguides is coupled through coupling slots to the stripline conductors which feed the corresponding GaAs diodes. Preferably, the waveguides are of circular shape although rectangular wave guides can also be used.

In order to increase the effective aperture of each waveguide, the ends of the circular waveguides are flared to form conical horns (e.g., using a suitable countersinking tool). Alternatively, a partially reflecting screen is advantageously located between the lens and waveguide array, preferably about ½ wavelength ($\lambda/2$) from the array, in order to increase the effective aperture and to reduce lens illumination "spill-over". The use of such a screen is disclosed in G. Von Trentini, "Partially Reflecting Sheet Arrays", IRE Trans. AP, October, 1956, pp 666–67.

Because mm-wave energy is attenuated by poor weather conditions, i.e., fog, rain and snow, much less than visible light energy, millimeter wavelength camera systems employing the focal plane antenna array assembly of the invention can be of real advantage in such conditions. It will be appreciated that good reception of aircraft-transmitted energy under such adverse weather conditions is of great importance in aircraft landing systems and the ability of such a millimeter wave camera system to "see through" such weather is critical. Although the present invention finds primary application in this field, it will be understood that the invention has other important applications as well.

It will be appreciated from the foregoing that one object of the invention is to provide a focal plane antenna array assembly which is both efficient and inexpensive to manufacture. Another object is to provide a camera system for generating video imaging signals using such an assembly. Another object is to provide such assembly or system which is particularly suited for shipboard use, and which provides particular advantages under heavy weather conditions.

Other objects, features and advantages of the invention will be set forth in, or apparent from, the following description of a preferred embodiment of the invention, taken with the appended drawings.

DETAILED DESCRIPTION OF A PREFERRED EMBODIMENT

Figure 1:
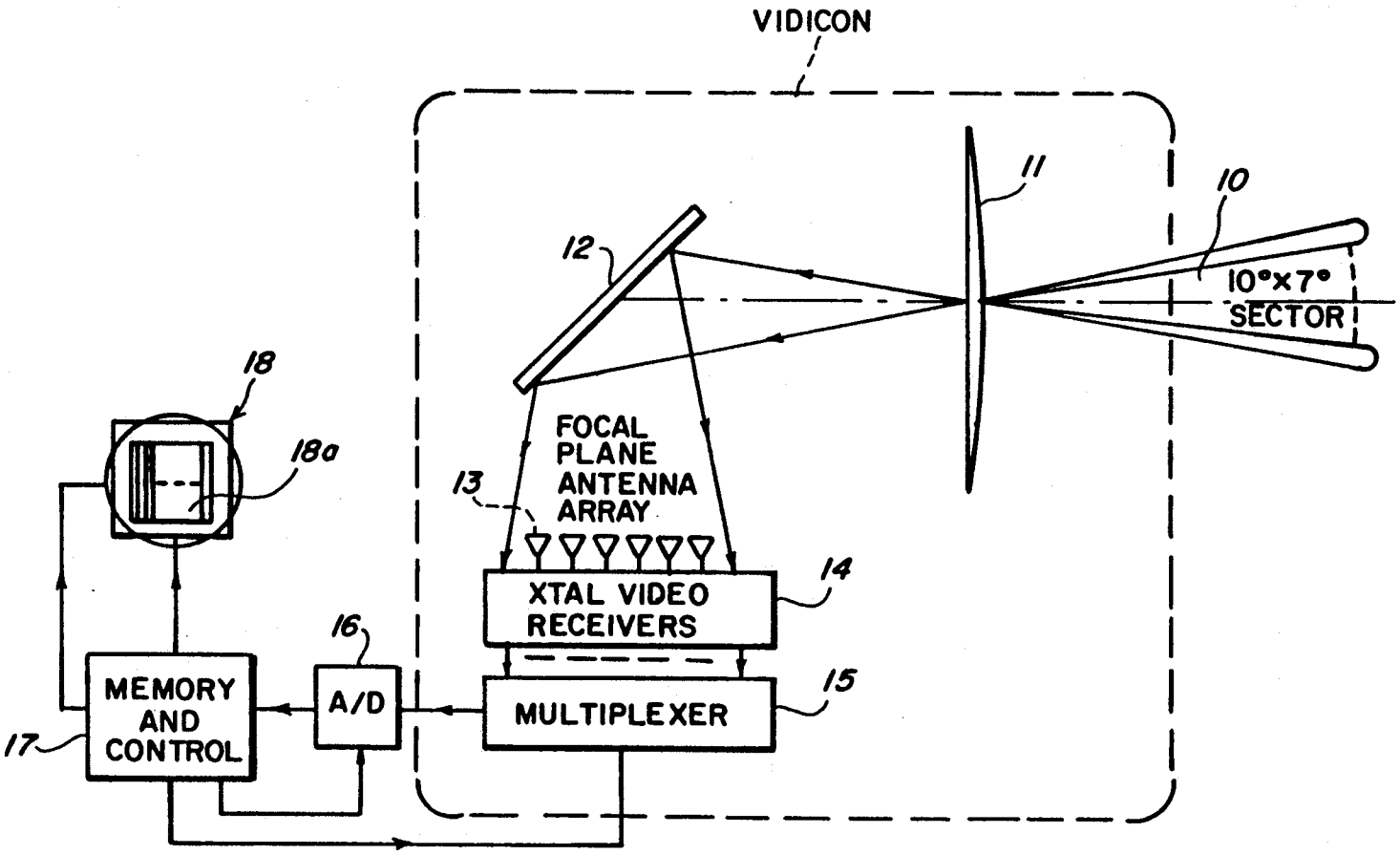
FIG. 1 is a diagram, partially in schematic block form, of a mm-wave imaging system in accordance with one aspect of the present invention.

Referring now to FIG. 1, a mm-wave imaging system is shown which in the embodiment under consideration, incorporates a 94 GHz vidicon. Incoming radiation, indicated at 10, from a 10°×7° sector in this exemplary embodiment, is focussed by a lens 11 onto a mirror or other reflecting surface 12. In the exemplary, non-limiting embodiment under consideration, lens 11 has a diameter of six feet and the distance to the focal plane is twice the lens diameter, that is, f/D=2. Radiation passing through lens 11 is directed by a reflecting surface 12 onto a focal plane antenna array 13 located at the effective focal plane of the lens 11. The focal plane antenna array will be described in more detail hereinbelow.

The individual elements of the antenna array 13 are respectively connected to individual crystal video receivers 14. The outputs of the receivers 14 are connected to a multiplexer 15 which transmits the individual receiver outputs in timed sequence over the same line to an analog to digital (A/D) converter 16. The output of the A/D converter 16 is connected to a memory and control unit, indicated at 17, which stores the digital signals from the A/D converter in sequence and then uses these signals to control an image display device 18. The latter can comprise a CRT including a screen of, e.g., 100×70 pixels, indicated at 18*a*. It will be appreciated that the processing of the outputs of the individual antenna elements of focal plane array 13 is basically conventional and thus further description of the video signal processing portion of the system of FIG. 1 is not seen to be necessary. In this regard, it is noted that the video from the multiplexer 15 need not be digitized, and if the CRT beam is synchronized with the multiplexer 15, the video may be stored directly on the CRT screen as in a standard television.

Figure 3:
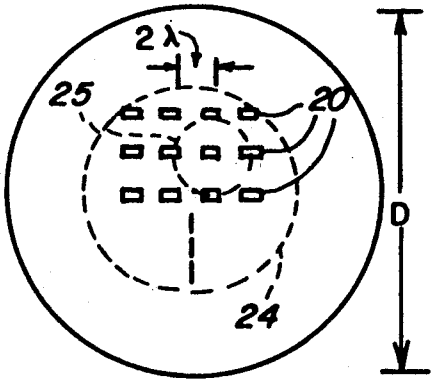
FIG. 3 is a front elevational view of the assembly of FIG. 2.
Figure 2:
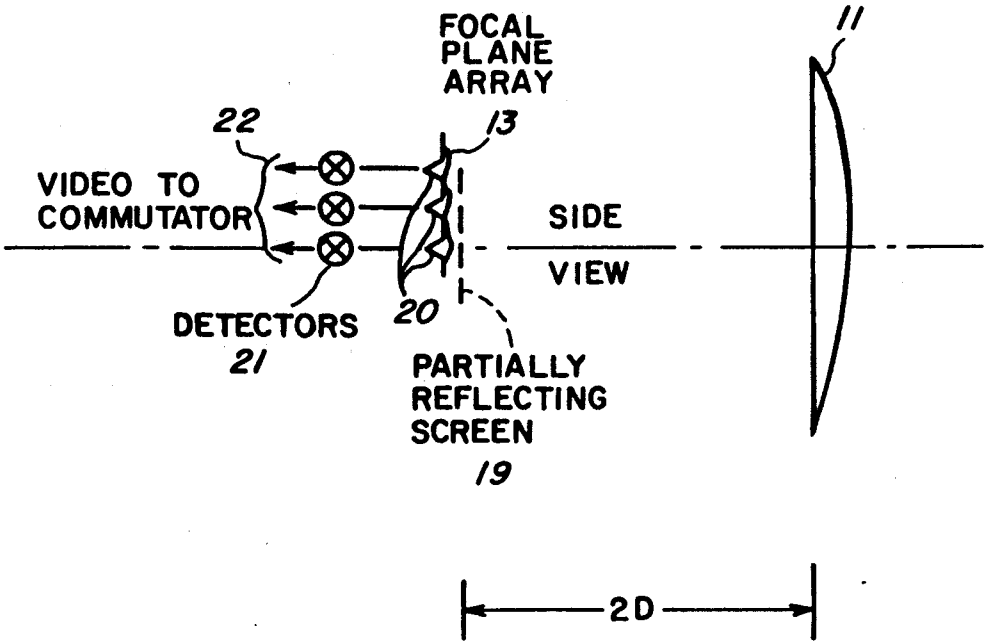
FIG. 2 is a diagrammatic side-elevational view of a focal plane antenna array assembly in accordance with the invention.

Referring now to FIG. 2 and FIG. 3, a focal plane antenna array assembly is shown in combination with a lens 11 of diameter D (FIG. 3). Lens 11 can be made from any suitable material and in this regard, can be milled, for example, from "Rexolite". The exact nature of lens and the material from which it is made form no part of the invention.

As illustrated in FIG. 2, a partially reflecting screen 19 of the type described above is positioned in front of focal plane array 13. Array 13 is formed by a plurality of rectangular waveguides which are indicated at 20 and which are connected to corresponding diode detectors indicated at 21. The outputs 22 of detectors 21 are connected to a suitable commutator or switching device (not shown). The diode detectors 21 are preferably of the Schottky-barrier type.

In an alternate, more sensitive embodiment, the diodes would constitute the mixer of a superheterodyne receiver (not shown). It is noted in this regard that the arrangement provided affords sufficient space to implement a local oscillator and an IF amplifier of such a superheterodyne receiver between each element.

It will be appreciated that FIG. 2 shows only a portion of the upper half of the focal plane antenna array 13, that is, a portion above the lens axis. The same is true of FIG. 3, which is a front view of the array shown in FIG. 2, with the optional partially reflecting screen 19 (which may not be needed in any event), removed for purposes of clarity.

The rectangular shapes of waveguides 20 are shown in FIG. 3, with the centers of the individual waveguides 20 being spaced in the embodiment under consideration by two wavelengths (2λ). The dashed line circle 24 indicates the 3 db illumination contour while the four wavelength (4λ) effective element aperture is indicated in dashed lines at 25. To explain, and referring in particular to the preferred embodiment discussed below which uses circular waveguides, the 3 db element beamwidth is about λ/d where d is the element diameter. Projected into this plane, the diameter of the 3 db illumination contour, IC, is 2 Dλ/d. Hence, if d=2λ, IC=D. If lower sidelobes are required, the partially reflecting screen 19 could be used to enlarge the effective element aperture thereby reducing the illumination contour.

Figure 5:
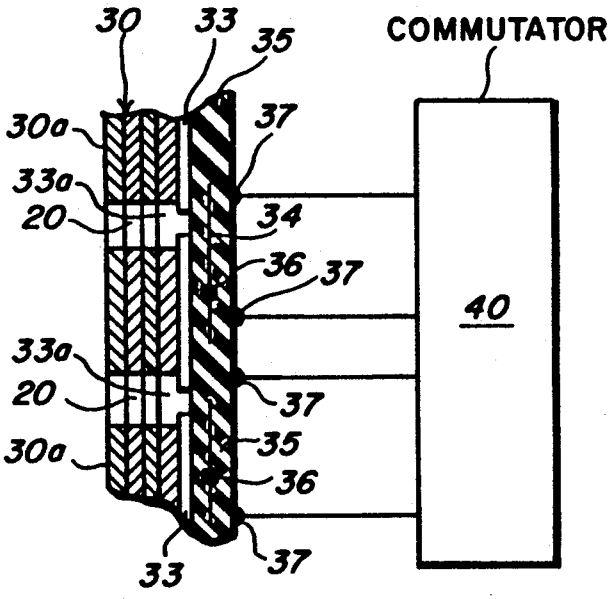
FIG. 5 is a side elevational view, partly in section and partially broken away, of the construction shown in FIG. 4.
Figure 4:
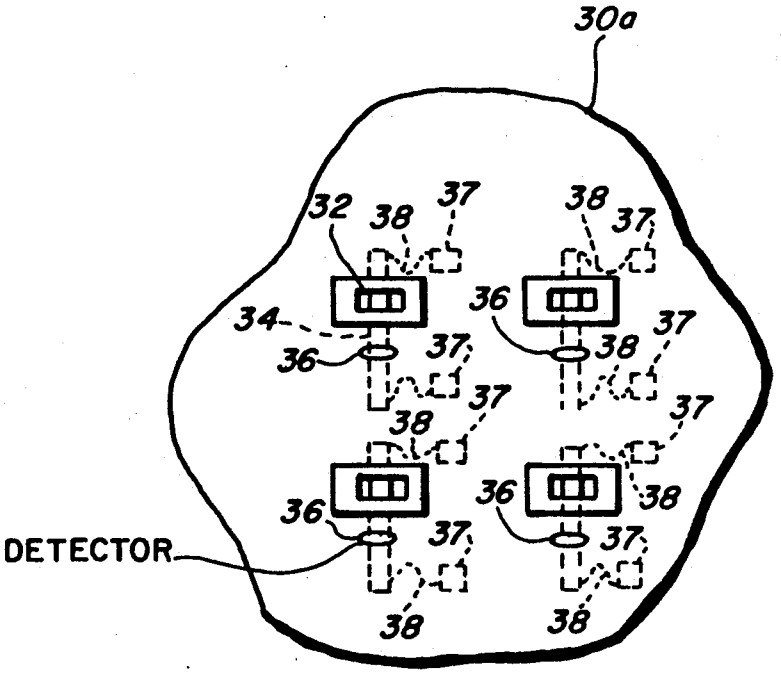
FIG. 4 is a front elevational view similar to that of FIG. 3 showing details of the construction of the antenna array assembly looking into the waveguides, with associated stripline conductors and detectors (diodes) shown in dashed lines behind the plates forming the waveguides.

Referring now to FIGS. 4 and 5, the front of a plate 30 defining the waveguides 20 in seen in FIG. 4. In this embodiment, plate 30, has a plurality of rectangular openings or perforations therein which form waveguides 20. A further, rearmost plate, denoted 33 in FIG. 5, includes smaller coupling or matching slots 30*a* which are in alignment with the associated waveguides 20 and which couple the waveguide radiation to the stripline detector assembly described below. FIG. 5 shows a preferred scheme for producing the perforations. In this embodiment, plate 30 comprises a plurality of plates 30 (the topmost of which is denoted in FIG. 5) which are punched separately and assembled so as to align the punched holes to form the slots 32. This simplifies the manufacturing process by eliminating the need for heavy duty punches to drive holes the full length of slots 32.

The stripline detector assembly includes a plated stripline conductor 34 centered behind each slot 32 as indicated in FIG. 4. The conductors 34 are preferably embedded in a monolithic (preferably GaAs) substrate or backing 35, which is semi-insulating and is affixed to the rearmost plate 33 of the waveguide assembly. A Schottky-barrier diode detector 36 is formed on each microstrip center conductor 34 by a suitable technique, such as ion implantation, selective etching or plating on single crystal GaAs substrates. Pairs of contacts 37 located on the back side of the dielectric material 35 and connected to opposite ends of a corresponding microstrip center conductor 34 by suitable leads 38 (FIG. 4) provide corresponding video outputs adapted to be sampled by a commutator or switching device 40. Commutator 40 generally corresponds to multiplexer 15 in FIG. 1, and preferably comprises a plurality of field effect transistor (FET) switches.

In FIG. 5, the laminations forming the plate 30 are preferably fabricated of aluminum and are stacked in sufficient number to provide waveguides 20 which are of a suitable length to reject unwanted low frequency interference. For 94 GHz operation the rectangular waveguide forming perforations in the laminations forming plate 30 are drilled or punched by numerically controlled machine, such as manufactured by Modern Metalsmiths, Inc. of Lorton, Va., to an accuracy of about 0.001 inch (0.025 mm) in thick aluminum sheet. For a rectangular waveguide 4 mm long, 8 layers or laminations are required, and because the cost of punching each perforation is very low (e.g., on the order of 0.3 cent per perforation), the total cost of one waveguide array (1 inch×2 inch as seen by the incoming radiation, with 6 mm. spacing) is relatively low.

In operation, waveguide energy is coupled through the slots in the GaAs ground plane to the stripline conductors 34 and is detected by diode detectors 36. The outputs of the individual detectors 36 are sequentially sampled by commutator 40 which provides the video imaging signals used in the overall system illustrated in FIG. 1.

Figure 6:
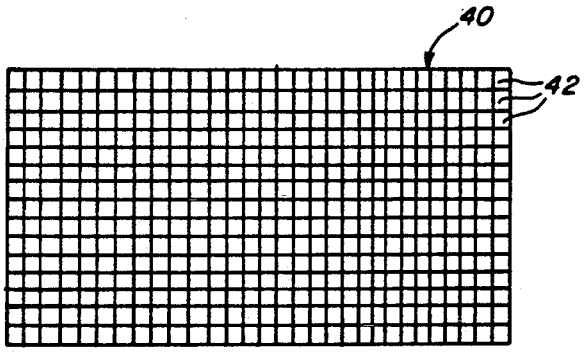
FIG. 6 is a plan view of a further embodiment of the focal plane antenna array of the invention.
Figure 7:
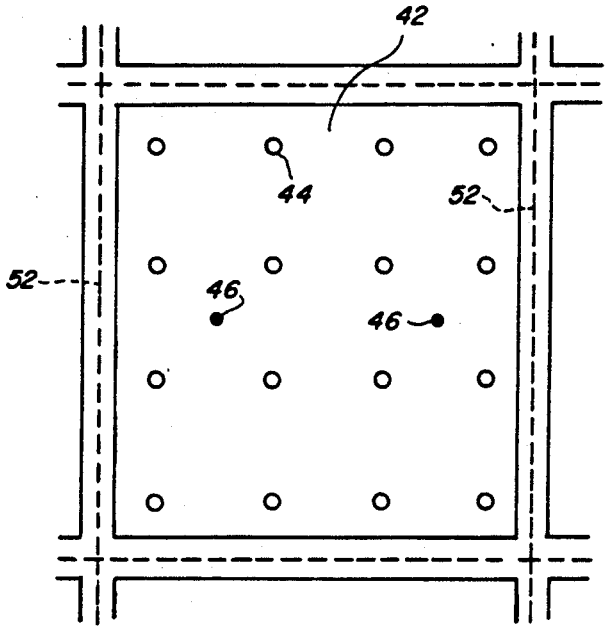
FIG. 7 is a plan view, to an enlarged scale, of one of the tiles of FIG. 6.
Figure 8:
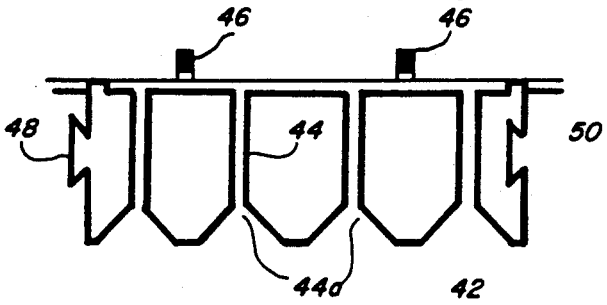
FIG. 8 is a cross-sectional view of the tile of FIG. 7.

As noted above, in a preferred embodiment of the invention, the waveguides used are circular and one such embodiment is illustrated in FIGS. 6 to 8, which figures illustrate the vidicon main support assembly and associated waveguides. In this exemplary embodiment, as shown in FIG. 6, an array 40 is formed by individual tiles 42 (one of which is illustrated in FIG. 7), wherein the full array is 15×30 tiles and the tiles are assumed to include 4×3 elements (as shown in FIG. 7) so that a total of 60×120 pixels is provided. The material used is preferably a copper/Invar sandwich, with one piece per tile to be assembled later into a full array. As shown in FIG. 7 the waveguides denoted 44 are round and a plurality of screws 46, which extend through holes in the tiles 42, provide alignment and support.

As shown in FIG. 8, the waveguides 44 are advantageously flared, as indicated at 44*a*, to form horns on the receiver side, as discussed hereinabove. The tiles 42 can be interlocked together by an arrangement of tabs 48 and slots 50 as illustrated in FIG. 8. As shown in FIG. 7, wires 52 for the associated circuitry are collected and tracked in areas between the individual tiles 42.

Figure 9:
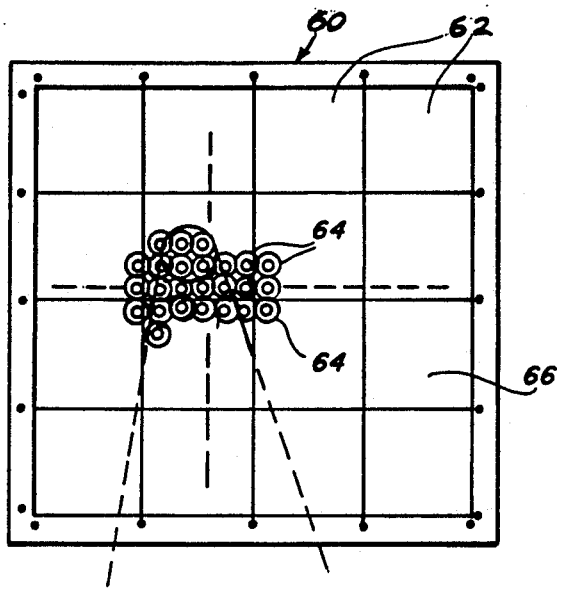
FIG. 9 is a plan view of yet another embodiment of the focal plane antenna array of the invention.

A further embodiment employing circular waveguides is illustrated in FIGS. 9, 10, 11 and 12. FIG. 9 shows a focal plane array 60 comprising sixteen tiles, denoted 62, each of which comprising 5×5 elements (waveguides), denoted 64, for a total of four hundred elements.

Figure 10:
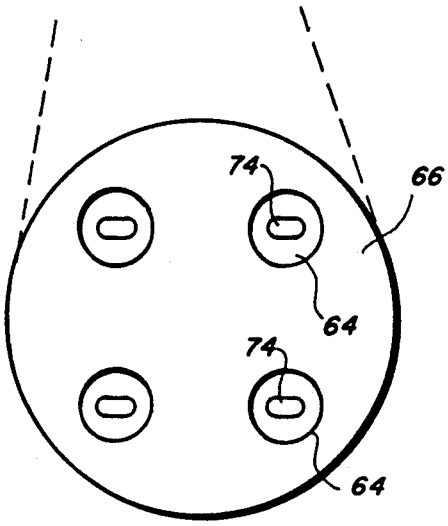
FIG. 10 is a plan view, to an enlarged scale, of the circled portion of FIG. 9 showing four circular waveguides.
Figure 11:
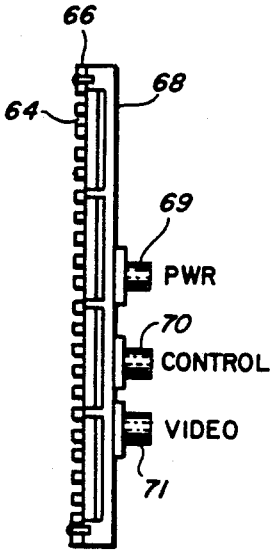
FIG. 11 is a cross-sectional view of the array of FIG. 9.
Figure 12:
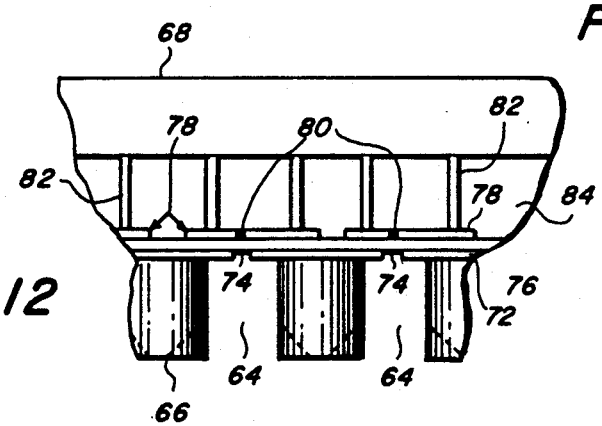
FIG. 12 is a cross-sectional view of the waveguides of FIG. 10.

In this embodiment, as shown in FIG. 10 which is a plan view to an enlarged scale of the circled area in FIG. 9, each waveguide 64 is circular in cross section and as shown in FIG. 11, the waveguides 64 are formed in a front plate 66 of an assembly including a multiplexer indicated schematically at 68 as well as power, control and video control connectors 69, 70, 71. As can be best be seen in FIG. 12 which is a fragmentary cross section of a portion of the assembly shown in FIG. 11, plate 66 forming waveguides 64 is connected to a backing plate 72 in which are formed slots 74 (see also FIG. 10) constituting a slot-to-microstrip coupler between waveguides 64 and a microstrip assembly including a silicon GaAs ground plane 76 and RF microstrip 78. Diodes 80 are connected in microstrips 78 as described above and plated throughholes 82, formed in a layer 84 of backing material, provide connections between microstrips 78 and the tile multiplexer 68. Although they are shown as being straight in FIG. 12, the waveguides 64 are preferably formed so as to include horns by providing tapered countersunk openings on the receiver side as discussed above and shown in FIG. 8.

The operation of the embodiments of FIGS. 6 to 8 and FIGS. 9 to 12 is, of course, essentially the same as that described above for the other embodiments.

Although in the non-limiting example described above, a lens diameter of 6 feet was given as exemplary, smaller versions are contemplated for airborne use, including the 4×4 tile construction described previously. As long as $f/D=2$, the basic tile design does not change and the element spacing is $d=2\lambda$ as discussed above. For airborne use, the lens might be, e.g., 2 feet in diameter and thus f would equal 4 feet.

As indicated above, the invention results in a construction which is economical to manufacture, and when aluminum or another similar metal is used, is light in weight. The invention is particularly suited for shipboard use, as on aircraft carriers, where the apparatus would receive millimeter radiation transmitted by aircraft transmitters. The invention can also be used to detect radiation sent by the ship and bounced off of the aircraft. The ability of such millimeter wavelength radiation to penetrate rain, fog, and the like enhances the use of a system incorporating the invention in facilitating landings during such adverse weather conditions.

The invention is as described above, of course, susceptible to variation within the scope and spirit of the appended claims and, for example, the waveguides could be of elliptical or other cross sectional shapes. Further, if desired in the embodiment using laminations, the slot size from lamination to lamination can be varied to produce pyramidal horns fed by a rectangular waveguide or conical horns fed by a circular waveguide. Thus, it will be understood by those skilled in the art that the invention is not limited to the exemplary embodiments described above and that modifications and variations can be effected in these embodiments without departing from the scope and spirit of the invention.

What is claimed is:

1. A millimeter-wave focal plane antenna array assembly which is adapted to receive millimeter wave radiation and which, in use, is positioned at the focal plane of a lens which receives said millimeter wave radiation, said assembly comprising:

means defining a planar array of a plurality of open ended waveguides which, in use, are disposed at said focal plane, and microstrip detector means coupled to said waveguides for detecting said millimeter wave radiation received thereby, said microstrip detector means comprising a dielectric substrate affixed to said array defining means, and a plurality of separate, unconnected microstrip conductors embedded in said substrate, each microstrip conductor being coupled to a respective one of said waveguides to receive said millimeter radiation therefrom, and a diode detector being connected to each said microstrip conductor for producing an output in accordance with said millimeter wave radiation coupled from a corresponding waveguide to the associated microstrip conductor;

wherein said waveguides are circular in cross section.

2. In a system including a focusing lens which receives millimeter wave radiation, a millimeter-wave focal plane antenna array assembly which is adapted to receive said millimeter wave radiation and which, in use, is positioned at the focal plane of said focusing lens, said assembly comprising:

means defining a planar array of a plurality of open ended waveguides which, in use, are disposed at said focal plane, and microstrip detector means coupled to said waveguides for detecting said millimeter wave radiation received thereby, said microstrip detector means comprising a dielectric substrate affixed to said array defining means, and a plurality of separate, unconnected microstrip conductors embedded in said substrate, each microstrip conductor being coupled to a respective one of said waveguides to receive said millimeter radiation therefrom, and a diode detector being connected to each said microstrip conductor for producing an output in accordance with said millimeter wave radiation coupled from a corresponding waveguide to the associated microstrip conductor;

said system being adapted for 94 Ghz operation wherein said lens is approximately 6 feet in diameter and the dimensions of said array of waveguides are about one inch by two inches, and said array of waveguides comprising a stack of eight aluminum sheets of a thickness of 0.5 mm each, with 1×2 mm perforations 6 mm apart in each sheet, the perforations in the stack being aligned to form the waveguides of the array of waveguides.

3. The system of claim 2, said system further comprising a partially reflecting screen located between said focusing lens and the focal plane and spaced approximately ½ wavelength from said focal plane.

4. A focal plane antenna array, comprising:

a plate having a plurality of apertures therein; and a semiconductor monolith comprising:

a semi-insulating semiconductor substrate;

a plurality of strip conductor means formed monolithically with said substrate, each of said plurality of strip conductor means being associated with a corresponding one of said plurality of apertures; and a plurality of semiconductor detector formed monolithically with said substrate, each of said plurality of detectors being associated with a corresponding one of said plurality of apertures;

wherein each said aperture is electromagnetically coupled to its corresponding strip conductor means effective to pass electromagnetic radiation at about microwave frequencies, and reject electromagnetic radiation at lower than about microwave frequencies, and each of said plurality of detectors is effective to detect electromagnetic radiation passed by the one of said plurality of apertures corresponding to said each of said plurality of detectors;

wherein said array includes a second plate, said second plate has a plurality of holes therein, and said second plate is disposed such that each of said plurality of holes is aligned with a corresponding one of said plurality of apertures so as to form a waveguide electromagnetically coupled to said associated one of said apertures;

wherein said array comprises one or more additional plates, each of said one or more additional plates having a plurality of holes therein, said second plate and each of said one or more additional plates being disposed such that said holes are aligned to form a plurality of passages having countersunk openings therein, each of said plurality of passages being aligned with a corresponding one of said apertures such that each of said plurality of passages forms a waveguide electromagnetically coupled to said corresponding one of said apertures.

5. The array of claim 4, further comprising:

video means for processing outputs of said plurality of semiconductor detectors; and commutator means for multiplexing the outputs of said plurality of semiconductor detectors between said detectors and said video means.

* * * * *